US006317917B1

(12) United States Patent
Hsu

(10) Patent No.: US 6,317,917 B1
(45) Date of Patent: Nov. 20, 2001

(54) STRUCTURE PAPER MOP BOARD FACING

(76) Inventor: Hsing-Yuan Hsu, No. 16, 96 Lane, Shuh-Der Street, Shang-Feng Village, Tai-Chung Hsien (TW)

( * ) Notice: Subject to any disclaimer, the term of this patent is extended or adjusted under 35 U.S.C. 154(b) by 0 days.

(21) Appl. No.: 09/458,944

(22) Filed: Dec. 10, 1999

(51) Int. Cl.[7] ..... A47L 13/20

(52) U.S. Cl. ..... 15/228; 15/231

(58) Field of Search ..... 15/228, 231, 232

(56) References Cited

U.S. PATENT DOCUMENTS

| | | | | |
|---|---|---|---|---|
| 3,012,264 | * | 12/1961 | Nash | 15/231 |
| 3,056,989 | * | 10/1962 | Murphy | 15/231 |
| 3,077,627 | * | 2/1963 | Ashworth | 15/228 |
| 3,099,955 | * | 8/1963 | Nash | 15/231 |
| 3,261,049 | * | 7/1966 | Murphy | 15/231 |
| 3,465,377 | * | 9/1969 | Thomas | 15/231 |
| 4,071,983 | * | 2/1978 | Thielen | 15/231 |
| 5,426,809 | * | 6/1995 | Muta | 15/231 |
| 5,657,507 | * | 8/1997 | Wasak | 15/232 |
| 5,839,147 | * | 11/1998 | Chia-Yi et al. | 15/231 |

FOREIGN PATENT DOCUMENTS

23149 * 10/1919 (GB) ..... 15/232

* cited by examiner

*Primary Examiner*—Terrence R. Till
(74) *Attorney, Agent, or Firm*—Dougherty & Troxell

(57) ABSTRACT

An improved structure paper mop board facing that is adhesion mounted at the ground level aspect and, furthermore, efficiently removes by absorption dust on floors. The paper mop board facing is adhesively attached to the floor section of the mop board and consists of a number of a pliable and, furthermore, disconnected and cross-laterally arrayed three-dimensional pattern of diagonal ridges on a plane surface, with the lower plane surface of the three-dimensional pattern lined with a non-weave fabric that provides for the wiping of floors. As such, when the said three-dimensional pattern of the paper mop is swabbed against a floor surface, the three-dimensional pattern on the underside of the paper mop board facing becomes deformed from the applied pressure and scours the floor, while crevices interspersed within the three-dimensional pattern of the paper mop board facing entrap dust. As the paper mop is moved along a floor surface, the ends of the three-dimensional pattern come into direct contact with the floor surface and, furthermore, stroke the floor such that dust is effectively held fast onto the three-dimensional pattern, which attracts by absorption the greater bulk of the dust encountered and enables the improved structure paper mop board of the invention herein to achieve the efficient removal of dust from floors.

1 Claim, 3 Drawing Sheets

STRUCTURE PAPER MOP BOARD FACING

BACKGROUND OF THE INVENTION

1) Field of the Invention

The invention herein relates to an improved structure paper mop board facing in which the paper mop board facing is adhesively attached to the floor section and consists of a number of a pliable and, furthermore, disconnected and cross-laterally arrayed three-dimensional pattern of diagonal ridges on a plane surface; as such, when the paper mop is moved along a floor surface, the ends of the three-dimensional pattern come into direct contact with the floor surface and, furthermore, mop the floor such that dust is effectively held fast onto the three-dimensional pattern, which attracts by absorption the greater bulk of the dust encountered and enables the improved structure paper mop board of the invention herein to achieve the efficient removal of dust from floors.

2) Description of the Prior Art

Conventional paper mop board facing structures, as indicated in FIG. 1, have a planar bottom area 3 and, therefore, when the non-weave fabric adhesively attached to the mop board facing is wiped across a floor surface, the planar bottom area 3 is situated against the floor surface to enable the mopping of the floor, the edges along the four sides directly mopping the floor such that dust is only held fast onto the four sides of the board facing, with only a smaller amount of dust clinging to the center of the board facing; as a result, dust cannot be efficiently attracted onto the paper mop board facing.

In view of the said shortcomings, the inventor of the invention herein conducted extensive research, including repeated testing and refinement, which culminated in the successful development of a totally new improved structure paper mop board facing that eliminates the said shortcomings of the conventional product and, furthermore, is capable of providing significantly greater practical performance.

SUMMARY OF THE INVENTION

The primary objective of the invention herein is to provide an improved structure paper mop board facing capable of effectively removing by absorption dust on floor surfaces, of which the paper mop board facing is adhesively attached to the floor section of the mop board and consists of a number of a pliable and, furthermore, disconnected and cross-laterally arrayed three-dimensional pattern of diagonal ridges on a plane surface, with the lower plane surface of the three-dimensional pattern lined with a non-weave fabric that provides for the wiping of floors; when the non-weave fabric adhesively attached to the mop board facing is wiped across a floor surface, crevices interspersed within the three-dimensional pattern disposed along the underside of the paper mop board facing entrap dust and as the paper mop is moved along a floor surface, the ends of the three-dimensional pattern come into direct contact with the floor surface and, furthermore, are deformed as they are pressed against the floor surface to thereby scour the floor such that dust is effectively held fast onto the ends of the three-dimensional pattern and, furthermore, the greater bulk of the dust encountered is attracted by absorption, enabling the improved structure paper mop board of the invention herein to achieve the efficient removal of dust from floors.

DETAILED DESCRIPTION OF THE INVENTION

Figures 1, 1A:
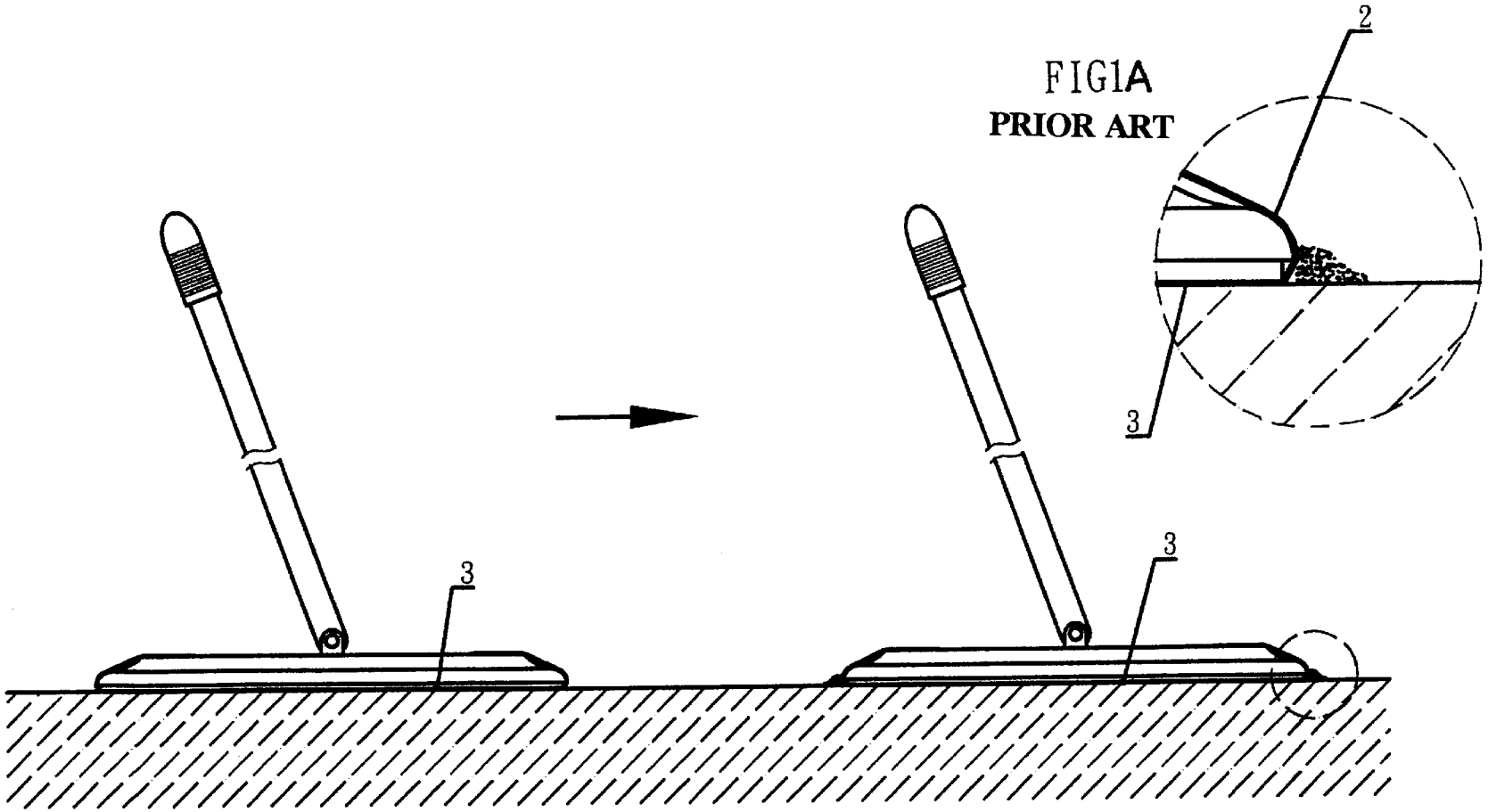
FIG1A PRIOR ART
FIG1 PRIOR ART
FIG. 1 is a schematic side view of the prior art mop.
FIG. 1A is an enlarged view of the circled area in FIG. 1.
Figure 2:
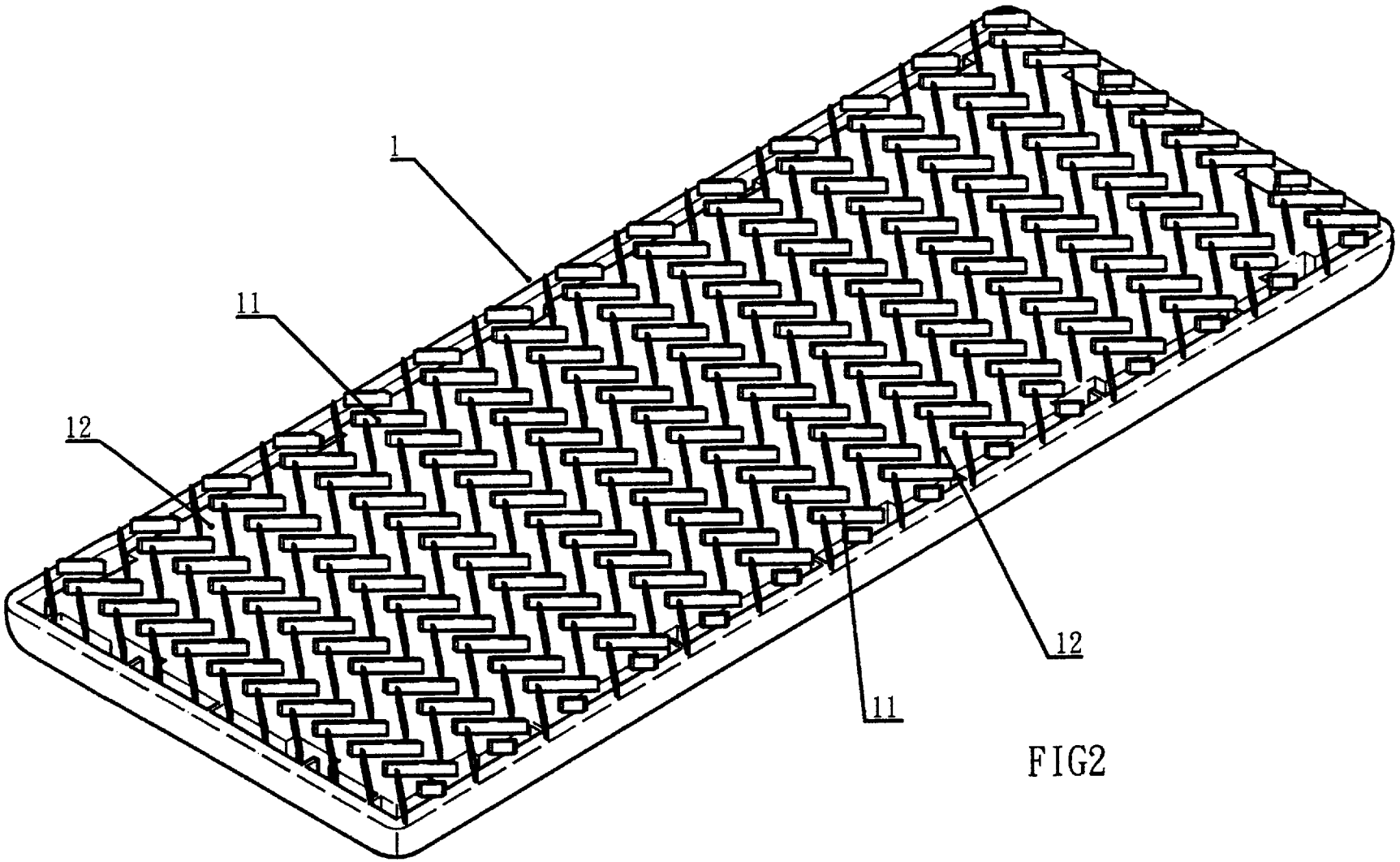
FIG. 2 is an isometric drawing of the invention herein.
Figures 3, 3A:
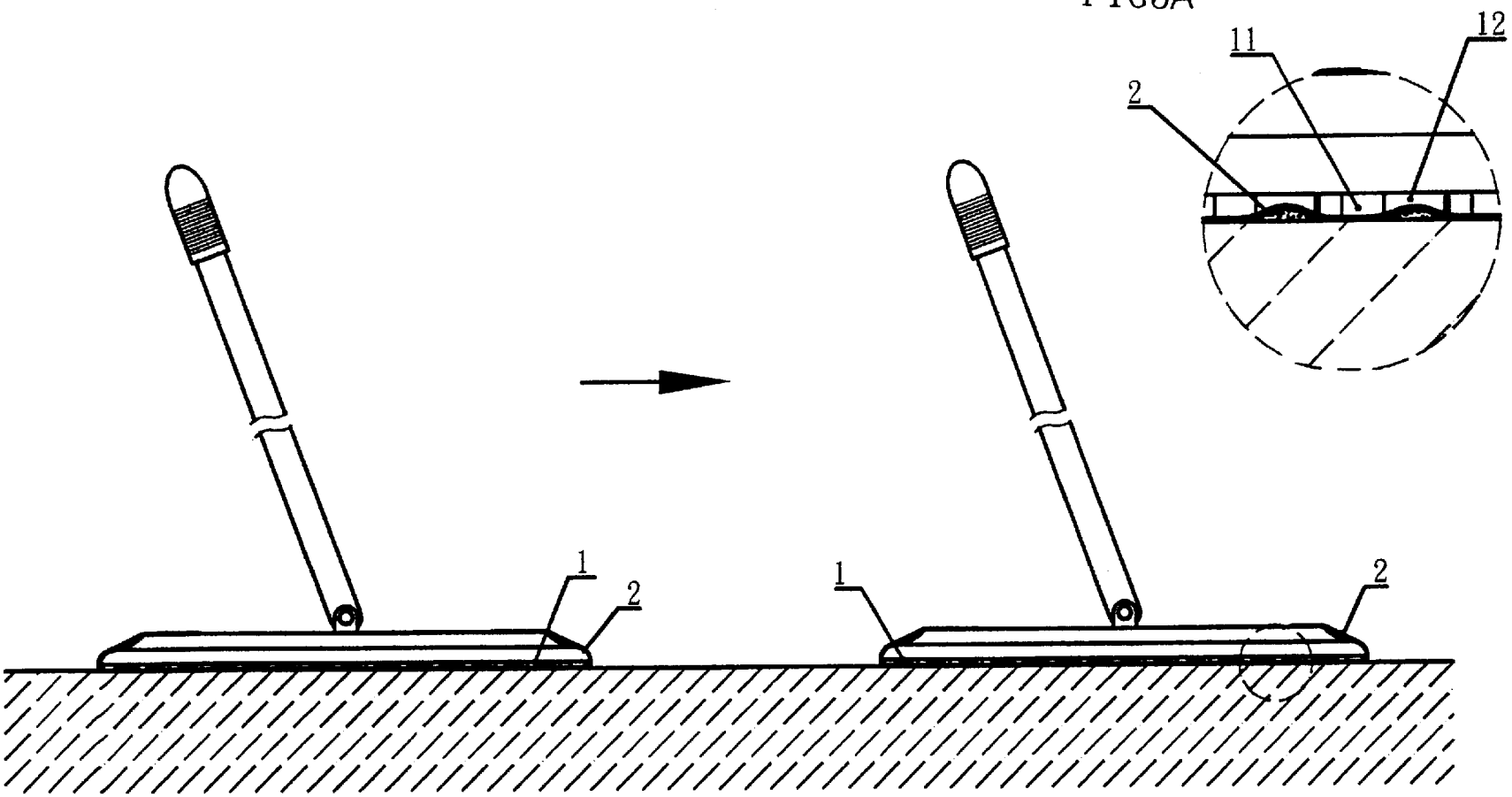
FIG. 3 is an orthographic drawing of the invention herein.
FIG. 3A is an enlarged view of the circled area in FIG. 3.

Referring to FIG. 1, FIG. 2, and FIG. 3, the structural arrangement of the invention herein, the paper mop board facing I of the invention herein is attached to a floor section of a mop and consists of a number of a pliable and, furthermore, disconnected and cross-laterally arrayed three-dimensional pattern 11 of diagonal ridges on a plane surface, with the distinguishing ridges of the said three-dimensional pattern 11 being of equal height and, furthermore, the lower plane surface of the three-dimensional pattern 11 is lined with a non-weave fabric 2 that provides for the wiping of floors; in addition, the three-dimensional pattern 11 of the paper mop board facing 1 of the present invention can be of any crisscross array, depending on application requirements. The thickness of each ridge member is less than a distance between adjacent ridge members in the same row.

When the non-weave fabric 2 directly adhered to the paper mop board facing 1 is wiped against a floor, crevices 12 interspersed within the three-dimensional pattern 11 of the paper mop board facing 1 entrap dust and as the paper mop continues to be moved along the floor, the ends of the three-dimensional pattern 11 are in direct contract with the floor surface such that dust is effectively held fast onto the three-dimensional pattern 11 ends, which attract by absorption the greater bulk of the dust encountered and enables the improved structure paper mop board of the invention herein to achieve the efficient removal of dust from floors.

In summation of the foregoing section, the improved structure paper mop invention herein features an innovative structure, is capable of achieving the original objectives and, furthermore, provides greater practical performance than products of the prior art.

What is claimed is:

1. A mop board facing attachable to a mop board and comprising:

a) a planar surface; and, b) a plurality of pliable ridge members extending outwardly from the planar surface arranged in a plurality of adjacent rows wherein the ridge members in each row are spaced apart and are parallel to each other and non-parallel to the ridge members in adjacent rows, each ridge member in each row having a rectangular configuration with a thickness, wherein the thickness of each ridge member is less than a distance between adjacent ridge members in a same row.

* * * * *